US009064462B2

(12) United States Patent
Yang

(10) Patent No.: US 9,064,462 B2
(45) Date of Patent: Jun. 23, 2015

(54) METHODS FOR COMPENSATING IMAGES AND PRODUCING BUILT-IN COMPENSATING MATRIX SET AND E-PAPER DISPLAY DEVICE THEREOF

(75) Inventor: Chang-Jing Yang, Taoyuan Hsien (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 363 days.

(21) Appl. No.: 13/571,840

(22) Filed: Aug. 10, 2012

(65) Prior Publication Data

US 2013/0038622 A1 Feb. 14, 2013

(30) Foreign Application Priority Data

Aug. 11, 2011 (TW) ..... 100128627 A

(51) Int. Cl.

| | |
|---|---|
| ***G09G 5/02*** | (2006.01) |
| ***G09G 3/30*** | (2006.01) |
| ***G09G 3/34*** | (2006.01) |
| *G09G 3/32* | (2006.01) |

(52) U.S. Cl.

CPC ..... *G09G 3/344* (2013.01); *G09G 3/3208* (2013.01); *G09G 2320/0233* (2013.01); *G09G 2320/0238* (2013.01); *G09G 2320/0242* (2013.01); *G09G 2320/0285* (2013.01); *G09G 2380/14* (2013.01)

(58) Field of Classification Search

CPC ..... G09G 3/36; G09G 3/3607; G09G 3/3648; G09G 3/3208; G09G 3/2003; G09G 2320/02–2320/0233; G09G 2320/0242; G09G 2320/04–2320/045; G09G 2320/0693

See application file for complete search history.

(56) References Cited

U.S. PATENT DOCUMENTS

| | | | | |
|---|---|---|---|---|
| 2006/0109391 | A1* | 5/2006 | Huitema et al. | 349/19 |
| 2011/0025587 | A1* | 2/2011 | Chen | 345/87 |
| 2011/0037774 | A1* | 2/2011 | Chen | 345/589 |
| 2011/0292087 | A1* | 12/2011 | Lim | 345/690 |

* cited by examiner

*Primary Examiner* — Tize Ma

(74) *Attorney, Agent, or Firm* — Muncy, Geissler, Olds and Lowe P.C.

(57) ABSTRACT

A method for compensating images, applied to an e-paper display where pixels are arranged as a pixel array displaying N-level grayscale images. Standard images from a first standard image to an N-th standard image which respectively correspond to a first-level grayscale value to the N-th-level grayscale value are provided. The e-paper display respectively displays the standard images. Actual grayscale values of each pixel of the e-paper display, from a first actual grayscale value corresponding to the first standard image to the N-th actual grayscale value corresponding to the N-th standard image, are obtained. Each m-th actual grayscale value is compared with an m-th-level grayscale value to generate an m-th compensating matrix, wherein m is a positive integer from 1 to N. Therefore, compensating matrices from a first compensating matrix to an N-th compensating matrix are generated and used to compensate an input image of the e-paper display.

6 Claims, 6 Drawing Sheets

S1

| | | | |
|---|---|---|---|
| 1 | 1 | 1 | 1 |
| 1 | 1 | 1 | 1 |
| 1 | 1 | 1 | 1 |

R1

| | | | |
|---|---|---|---|
| 1 | 2 | 2 | 1 |
| 1 | 3 | 1 | 1 |
| 2 | 1 | 1 | 2 |

C1

| | | | |
|---|---|---|---|
| 0 | 1 | 1 | 0 |
| 0 | 2 | 0 | 0 |
| 1 | 0 | 0 | 1 |

FIG. 2b

METHODS FOR COMPENSATING IMAGES AND PRODUCING BUILT-IN COMPENSATING MATRIX SET AND E-PAPER DISPLAY DEVICE THEREOF

CROSS REFERENCE TO RELATED APPLICATIONS

This Application claims priority of Taiwan Patent Application No. 100128627, filed on Aug. 11, 2011, the entirety of which is incorporated by reference herein.

BACKGROUND OF THE INVENTION

1. Field of the Invention

The invention relates to a method for compensating images, and more particularly to a method for compensating images of e-paper displays at a pixel level.

2. Description of the Related Art

An electronic paper display (e-paper display or EPD) is a new type of display. Features of the electronic paper display include thinness, flexibility and energy savings. Current technologies of electronic paper displays include micro-capsule electrophoretic displays, micro-cups electrophoretic displays and quick response liquid powder displays (QR-LPD).

Electronic paper displays display images by applying an electric field to pixels to drive electrified color particles in the pixels. Distribution and movement of the electrified color particles varies according to direction, voltage magnitude and pulse width of the applied electric field, and thus pixels display different colors and luminance. Nevertheless, sometimes when the same driving wave is applied to all pixels, optical responses of the pixels are not the same. Therefore, problems such as noise and a decrease in contrast ratio occur.

BRIEF SUMMARY OF THE INVENTION

In view of the above, the invention provides a method for compensating images to deal with the inconsistent optical response of electronic paper displays.

One embodiment of the invention provides a method for compensating images at a pixel level, applied to an electronic paper display displaying N-level grayscale images, wherein pixels of the electronic paper display are arranged as a pixel array, and the N-level grayscale comprises grayscale values from a first-level grayscale value to an N-th-level grayscale value. The method comprises: providing a first standard image where each pixel has the first-level grayscale value; displaying a first image by the electronic paper display corresponding to the first standard image; obtaining a first actual grayscale value of each pixel of the electronic paper display when the electronic paper display displays the first image; comparing the first-level grayscale value with the first actual grayscale value of each pixel to generate a first compensating matrix, wherein compensating elements in the first compensating matrix are arranged corresponding to the pixel array; providing standard images from a second standard image to an N-th standard image which respectively correspond to grayscale values from a second-level grayscale value to the N-th-level grayscale value, and repeating the steps above to respectively generate compensating matrices from a second compensating matrix to an N-th compensating matrix; compensating an input image of the electronic paper display according to the first compensating matrix to the N-th compensating matrix; and displaying an output image according to the compensated input image, wherein N is an positive integer.

Another embodiment of the invention provides a method for generating a compensating matrix set, applied to an electronic paper display displaying N-level grayscale images, wherein pixels of the electronic paper display are arranged as a pixel array, and the N-level grayscale comprises grayscale values from a first-level grayscale value to an N-th-level grayscale value. The method comprises: providing a first standard image where each pixel has the first-level grayscale value; displaying a first image by the electronic paper display corresponding to the first standard image; obtaining a first actual grayscale value of each pixel of the electronic paper display when the electronic paper display displays the first image; comparing the first-level grayscale value with the first actual grayscale value of each pixel to generate a first compensating matrix, wherein compensating elements in the first compensating matrix are arranged corresponding to the pixel array; providing standard images from a second standard image to an N-th standard image which respectively correspond to grayscale values from a second-level grayscale value to the N-th-level grayscale value, and repeating the steps above to respectively generate compensating matrices from a second compensating matrix to an N-th compensating matrix; and generating the compensating matrix set, wherein the compensating matrix set comprises compensating matrices from the first compensating matrix to the N-th compensating matrix, and N is an positive integer.

Still another embodiment of the invention provides an electronic paper display, comprising: a processor, receiving an input image; a storage module, storing a built-in compensating matrix set generated by the method for generating the compensating matrix set as described in above embodiment; a compensating module, coupled between the processor and the storage module, using the compensating matrix set to compensate the input image to generate a compensated image matrix and transmitting the compensated image matrix to the processor, and a display, coupled to the processor, receiving the compensated image matrix processed by the processor and displaying an output image according to the processed compensated image matrix.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein:

FIG. 2*b* illustrates block diagrams of a standard image, a matrix of real grey values and a compensating matrix;

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

In the following embodiments, though a QR-LPD is used as an exemplary electronic paper display, the method for compensating images and/or the electronic paper display described in the invention are/is not limited to the QR-LPD.

Figure 1:
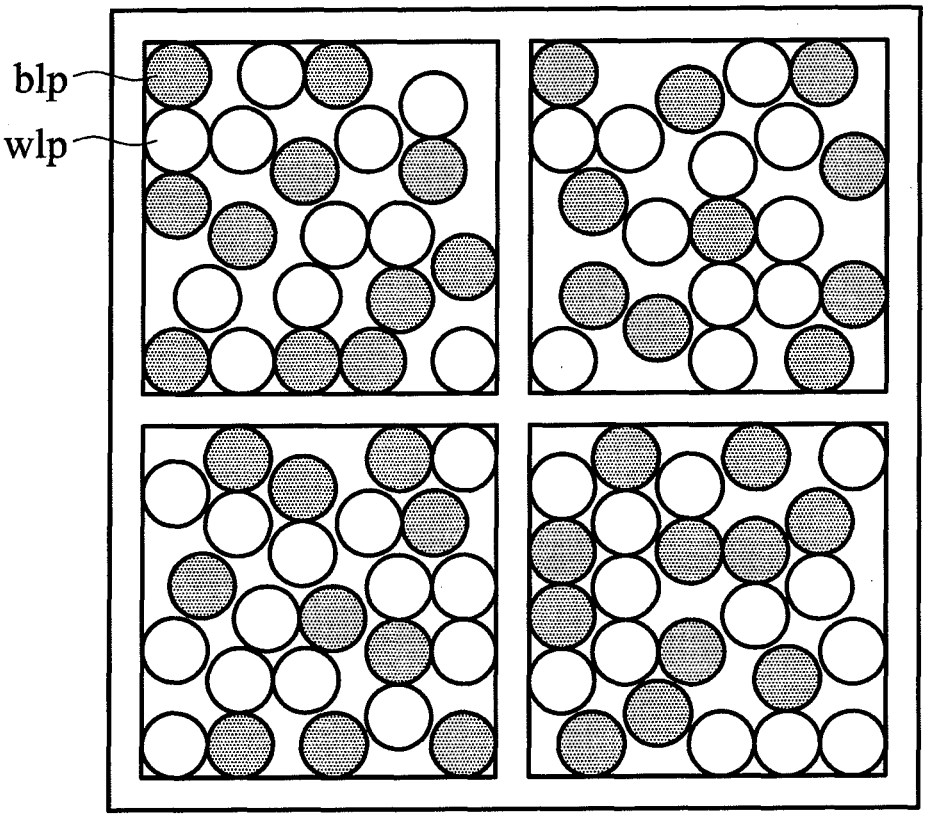
FIG. 1 illustrates a block diagram of a QR-LPD.

A QR-LPD is a dry-type display. An appropriate number of colored liquid powders, such as black and white liquid powders, are provided between two electrodes of the QR-LPD. Note that the invention is not limited to black and white liquid powders. A distance between the two electrodes is about 50~100 μm. An average diameter of liquid powders is 0.1~20 μm. FIG. 1 illustrates a block diagram of a QR-LPD. As shown in FIG. 1, each grid of the QR-LPD is defined as a pixel. For example, there are 4 pixels in FIG. 1. Pixels are separated by sticks. Each pixel contains an appropriate number of black liquid powders, denoted as blp, and an appropriate number of white liquid powders, denoted as wlp. Black liquid powders blq and white liquid powders wlp have different electric polarities (positive and negative). Therefore, distribution and movement of black liquid powders blq and white liquid powders wlp between the two electrodes are different depending on voltage and pulse width of an electric filed between the two electrodes. Thus, the QR-LPD may display different grayscales. For example, black liquid powders blq are charged positively and white liquid powders wlp are charged negatively. When a positive voltage is applied to a front-end transparent substrate (not shown in the figure), white liquid powders wlp move toward the front-end transparent substrate and reflect incident ambient light and thus display white color. On the other hand, when a negative voltage is applied to the front-end transparent substrate, black liquid powders blq move toward the front-end transparent substrate and reflect incident ambient light and thus display black color. Based on above description, the distribution of black liquid powders and white liquid powders in a pixel space is different depending on voltage, and thus different grayscales are displayed.

Sizes of all liquid powders may vary when producing liquid powders. In addition, when pixels are being filled with liquid powders, the pixels may not contain the same amount of liquid powders. Therefore, a threshold value to drive a pixel varies from pixel to pixel. Accordingly, an optical response of a pixel varies from pixel to pixel even if the same driving waveform is applied to all the pixels. In other words, luminance varies from pixel to pixel even if the same driving waveform is applied to all the pixels. The luminance difference among pixels is not obvious when the QR-LPD simply displays an all-white or all-black image. However, when pixels of the QR-LPD are driven toward an opposite direction, such as when the image displayed by the QR-LPD changes from all-white to all-black, uneven optical responses are more noticeable.

Note that liquid powders and pixel grids in FIG. 1 are not drawn in proportion to each other. In FIG. 1, the sizes of the liquid powders are enlarged and all liquid powders are drawn at the same scale for clarity.

Figure 2A:
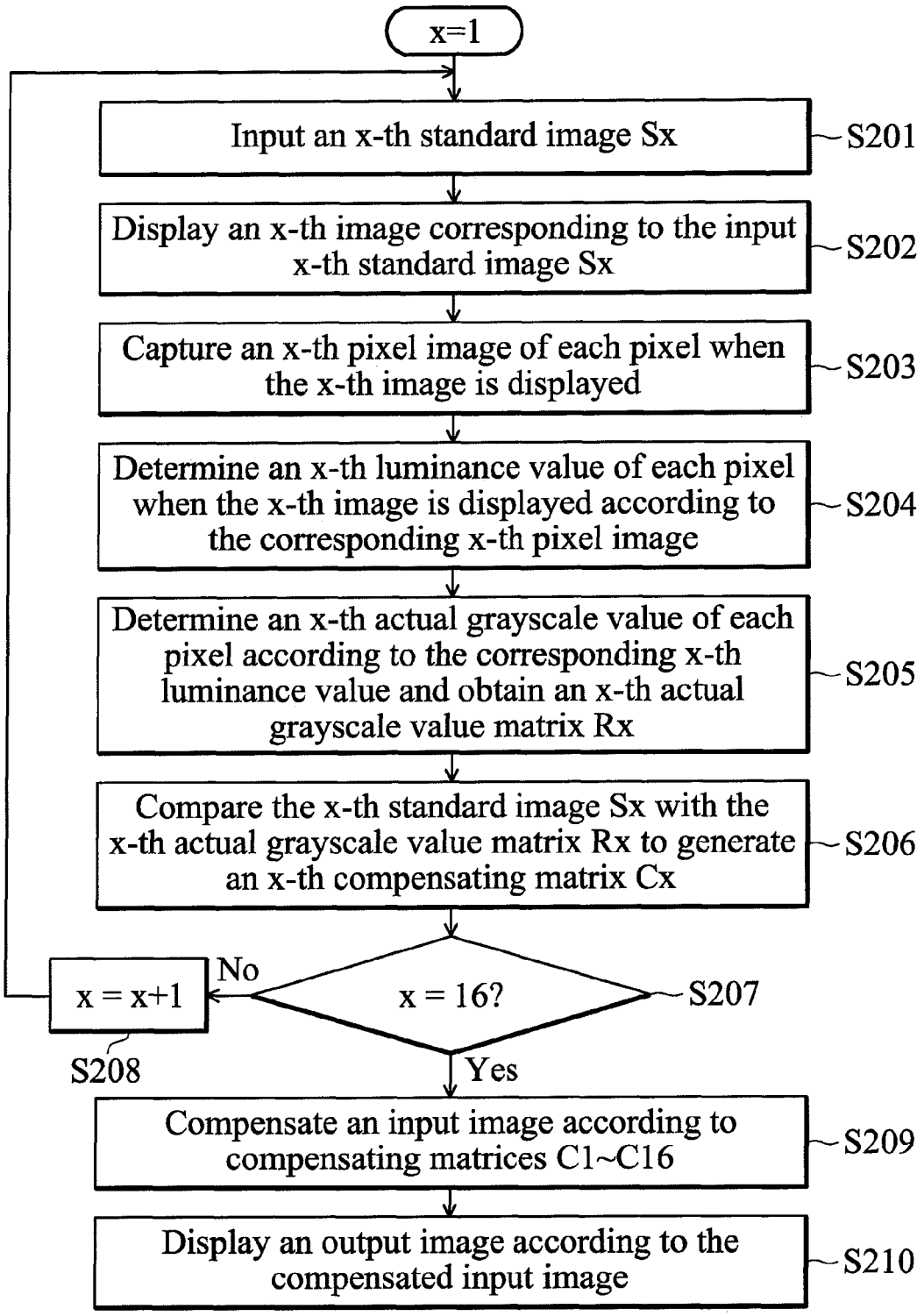
FIG. 2*a* illustrates a flowchart of a method for compensating images according to one embodiment of the invention.

FIG. 2*a* illustrates a flowchart of a method for compensating images according to one embodiment of the invention. In the embodiment, a QR-LPD is still used as an exemplary electronic paper display. The QR-LPD displays 16-level grayscale images. That is, a grayscale value of a pixel of the QR-LPD is one of 1~16. The QR-LPD of the embodiment shown in the figure has a width of 4 pixels and a height of 3 pixels for brevity. Numbers described above are only exemplary and may be modified according to practical application.

In the embodiment, x=1, 2, 3 . . . and other integers. First of all, as shown in step S201, a first standard image S1 is input into the QR-LPD. A pixel value of each pixel of the first standard image S1 is the first-level grayscale value (that is, the pixel value of every pixel of the first standard image S1 is 1). The size of the first standard image S1 is 4*3, as shown in FIG. 2*b*. Then in step S202, the QR-LPD displays a first image corresponding to the input first standard image S1. In step S203, a microscope is used to capture a first pixel image of every pixel of the QR-LPD when the QR-LPD displays the first image. For example, when the QR-LPD displays the first image, the microscope takes two partial images with sizes of 2*3. The two partial images are an image of a left-part of the QR-LPD and an image of a right-part of the QR-LPD. Then the two 2*3 partial images are divided into images at a pixel level. That is, each of the two partial images is divided into 6 images, each of which corresponds to a pixel. Therefore, 12 first pixel images are obtained. A pixel image is like the pixel grid shown in FIG. 1. In step S204, a first luminance value of every pixel of the QR-LPD when the QR-LPD displays the first image is determined according to the corresponding first pixel image. In step S205, a first actual grayscale value of every pixel is determined according to the corresponding first luminance value. Therefore, a first actual grayscale value matrix R1 is obtained. Each element of the first actual grayscale value matrix R1 stores a first actual grayscale value of a corresponding pixel of the QR-LPD, as shown in R1 in FIG. 2*b*. For example, based on the 12 first pixel images, image processing and other methods are used to determine the first luminance value of each pixel. Then all the first luminance values are normalized. The corresponding first actual grayscale value is determined according to the normalized first luminance values.

In step S206, the first actual grayscale value matrix R1 is compared with the first standard image S1 to generate a first compensating matrix C1. For example, the first compensating matrix C1 is equal to a matrix generated by subtracting the first standard image S1 from the first actual grayscale value matrix R1. (Here, the first standard image S1 is equal to a matrix where each element is 1) In other words, each element in the first compensating matrix C1 is equal to a first actual grayscale value of a corresponding element in the first actual grayscale value matrix R1 minus 1 (the first-level grayscale value), as shown in C1 in FIG. 2*b*. The position of the corresponding element in the first actual grayscale value matrix R1 is the same as the element in the first compensating matrix C1.

Figure 2C:
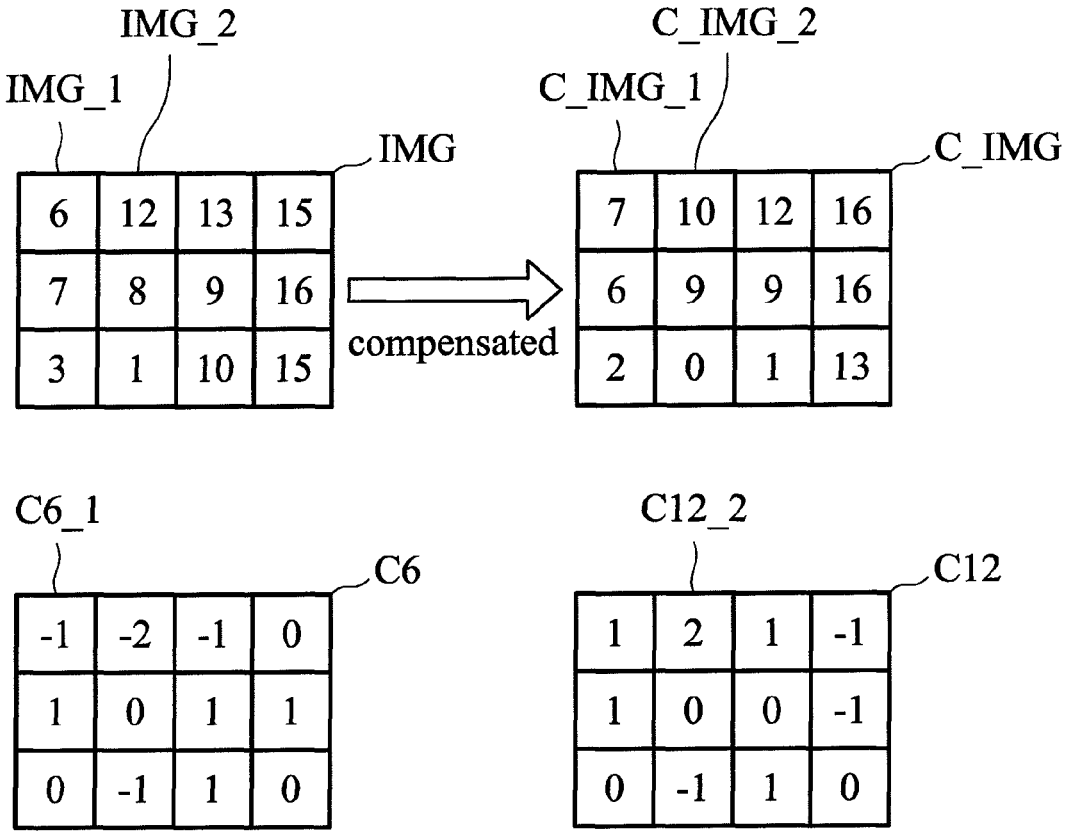
FIG. 2*c* illustrates block diagrams of an input image, a compensating matrix and a compensated image matrix.

Then steps S201 to S206 are repeated to generate compensating matrices from a second compensating matrix C2 to a sixteenth compensating matrix C16. When compensating matrices from the first compensating matrix C1 to the sixteenth compensating matrix C16 are generated, in step S209, a compensated image matrix C_IMG of an input image IMG is generated according to the compensating matrices C1 to C16. Sizes of the input image IMG and the compensated image matrix C_IMG are all 4*3. A value of each compensated image element in the compensated image matrix C_IMG is a grayscale value of a corresponding pixel in the input image IMG minus a value of a corresponding element in a compensating matrix corresponding to the grayscale value. Take FIG. 2*c* as an example, the input image IMG is a 16-level grayscale image. A grayscale value of a pixel IMG__1 in the input image IMG is 6, and thus the pixel IMG_1 is compensated for by the sixth compensating matrix C6. A value of a compensating element C6_1 having a position corresponding to the pixel IMG_1 in the input image IMG is −1. Therefore, a value of a compensated image element C_IMG_1 having a position corresponding to the pixel IMG_1 in the input image IMG is equal to 6−(−1)=7. A grayscale value of another pixel IMG_2 in the input image IMG is 12, and thus the pixel IMG_2 is compensated for by the twelfth compensating matrix C12. A value of a compensating element C12_2 having a position corresponding to the pixel IMG_3 in the input image IMG is 2. Therefore, a value of a compensated image element C_IMG_2 having a position corresponding to the pixel IMG_2 in the input image IMG is equal to 12−2=10. Each pixel of the input image is compensated as described above to obtain a value of each compensated image element in the compensated image matrix C_IMG.

Then in step S210, the QR-LPD displays an output image according to the compensated input image. That is, the QR-LPD displays the output image according to the compensated image matrix C_IMG.

The compensating matrices C1 to C16 may be generated before the QR-LPD is dispatched from the factory. Furthermore, the compensating matrices C1 to C16 are built-in into a storage module. Therefore, every time the QR-LPD receives an input image, the compensating matrices C1 to C16 built-in into the storage module are used to compensate the input image. As shown in step S203, in the method, compensation is based on the pixel image of each pixel, and thus the method is a compensating method at a pixel level. Accordingly, the problem such as a decrease in resolution during the compensation is mitigated. Note that the 16-level grayscale values are only exemplary. A skilled person in the art may easily apply the invention to a higher- or a lower-level grayscale display device or other color display devices.

Figure 3:
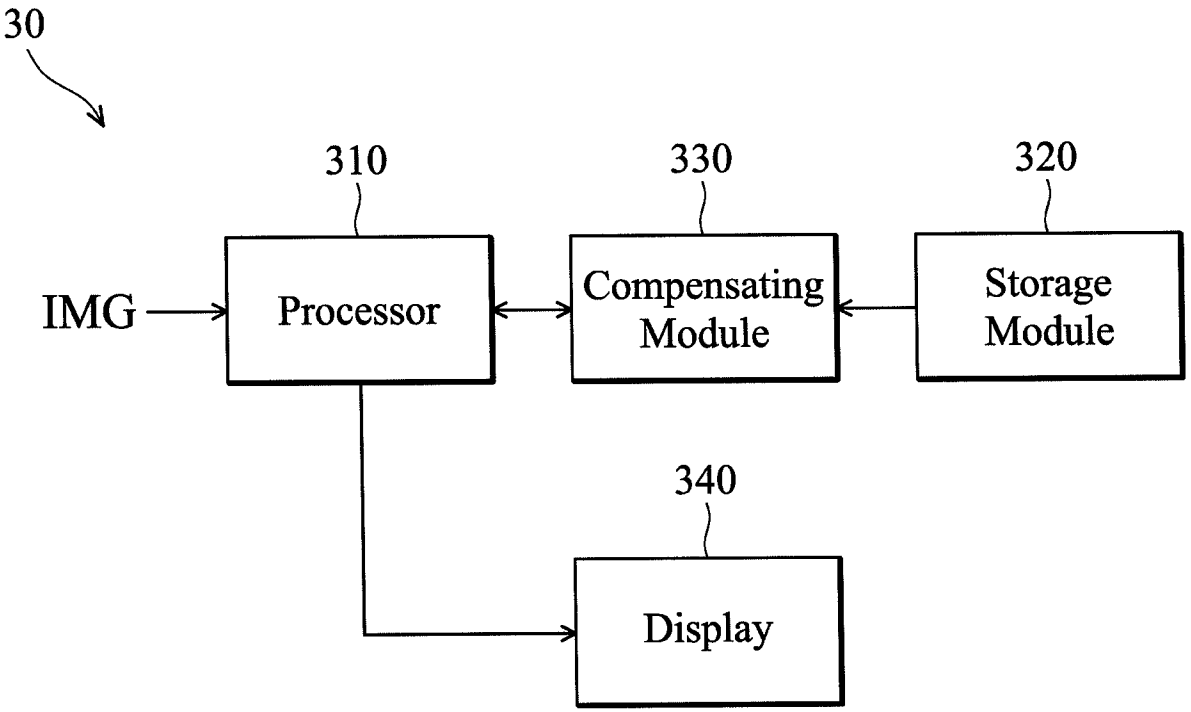
FIG. 3 illustrates a block diagram of an electronic paper display according to one embodiment of the invention.

FIG. 3 illustrates a block diagram of an electronic paper display 30 according to one embodiment of the invention. The electronic paper display 30 comprises a processor 310, a storage module 320, a compensating module 330 and a display 340. The storage module 320 stores the compensating matrices C1 to C16 described above. Each of the compensating matrices C1 to C16 is generated according to steps S201 to S206 as described above. The processor 310 receives the input image IMG. The compensating module 330, coupled between the storage module 320 and the processor 310, uses the compensating matrices C1 to C16 to compensate the input image IMG so as to generate the compensated image matrix C_IMG, as shown in step S209 in FIG. 2, and transmits the compensated image matrix C_IMG to the processor 310. In the embodiment, the display 340 is a QR-LPD. The display 340, coupled to the processor 310, receives the compensated image matrix C_IMG which is processed and transmitted by the processor 310 and displays the output image according to the compensated image matrix C_IMG as shown in step S210 in FIG. 2.

Figure 4:
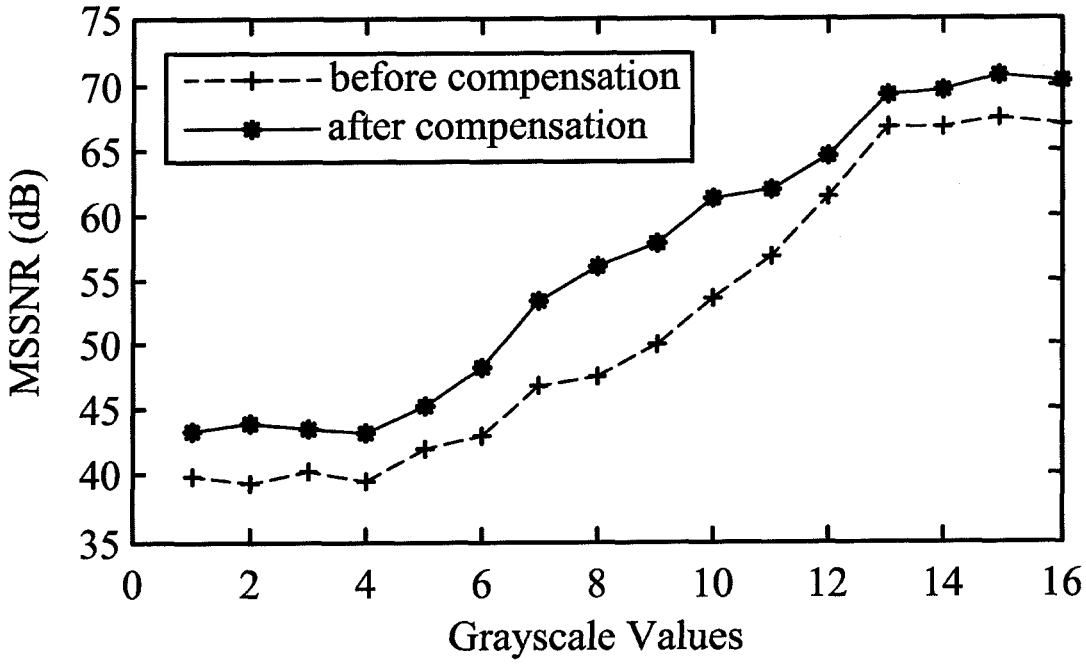
FIG. 4 illustrates a block diagram of the compensating result according to embodiments of the invention.

As described in the above embodiments, the compensating method of the invention may be used to compensate for inconsistent optical responses of electronic paper displays. FIG. 4 illustrates a block diagram of the compensating result according to embodiments of the invention. The vertical axis of the FIG. 4 represents MSSNR (Mean Square Signal to Noise Ratio), and the horizontal axis of the FIG. 4 represents grayscale values. MSSNR is calculated as follows:

$$MSSNR = \frac{\sum_{x=0}^{M-1}\sum_{y=0}^{N-1}\tilde{f}(x,y)^2}{\sum_{x=0}^{M-1}\sum_{y=0}^{N-1}\left[\tilde{f}(x,y)-f(x,y)\right]^2},$$

wherein M is a width of the displayed image, N is a height of the displayed image, f(x,y) is a grayscale value of the input image, and $\tilde{f}$(x,y) is a grayscale value captured by the microscope when the QR-LPD displays the output image.

In FIG. 4, before the QR-LPD receives an input image, the initial image of the QR-LPD is an all-white image (grayscale value is 16). Therefore, as grayscale values reduce, MSSNR reduces. That is, uneven optical responses are more noticeable when the QR-LPD is driven toward an opposite direction (toward black). As shown in FIG. 4, after compensated for by the compensating method as described in the invention, MSSNR is improved. For example, the improvement in MSSNR is 8.647 dB at a middle grayscale value, and the average improvement in MSSNR is 4.662 dB. Accordingly, based on embodiments of the invention, uneven optical responses of electronic paper displays can be efficiently compensated for.

Though the above embodiments have been described by way of the QR-LPD, the invention is not limited thereto. The compensating method can also be applied to other electronic paper displays that have uneven optical responses, such as electrophoretic e-paper displays.

Methods and systems of the present disclosure, or certain aspects or portions of embodiments thereof, may take the form of a program code (i.e., instructions) embodied in media, such as floppy diskettes, CD-ROMS, hard drives, firmware, or any other non-transitory machine-readable storage medium, wherein, when the program code is loaded into and executed by a machine, such as a computer, the machine becomes an apparatus for practicing embodiments of the disclosure. The methods and apparatus of the present disclosure may also be embodied in the form of a program code transmitted over some transmission medium, such as electrical wiring or cabling, through fiber optics, or via any other form of transmission, wherein, when the program code is received and loaded into and executed by a machine, such as a computer, the machine becomes an apparatus for practicing and embodiment of the disclosure. When implemented on a general-purpose processor, the program code combines with the processor to provide a unique apparatus that operates analogously to specific logic circuits.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A method for compensating images at a pixel level, applied to an electronic paper display displaying N-level grayscale images, wherein pixels of the electronic paper display are arranged as a pixel array, and the N-level grayscale comprises grayscale values from a first-level grayscale value to an N-th-level grayscale value, the method comprising:

providing a first standard image where each pixel has the first-level grayscale value;

displaying a first image by the electronic paper display corresponding to the first standard image;

using a microscope to capture a plurality of partial images of the electronic paper display when the electronic paper display displays the first image;

dividing the plurality of partial images into a plurality of pixel images;

determining a first luminance value of each pixel of the electronic paper display when the electronic paper display displays the first image according to the plurality of pixel images;

normalizing the first luminance value of each pixel;

determining the first actual grayscale value of each pixel according to the normalized first luminance value;

obtaining a first actual grayscale value of each pixel of the electronic paper display when the electronic paper display displays the first image;

comparing the first-level grayscale value with the first actual grayscale value of each pixel to generate a first compensating matrix, wherein compensating elements in the first compensating matrix are arranged corresponding to the pixel array;

providing standard images from a second standard image to an N-th standard image which respectively correspond to grayscale values from a second-level grayscale value to the N-th-level grayscale value, and repeating the steps above to respectively generate compensating matrices from a second compensating matrix to an N-th compensating matrix;

compensating an input image of the electronic paper display according to the first compensating matrix to the N-th compensating matrix; and displaying an output image according to the compensated input image, wherein N is a positive integer.

2. The method as claimed in claim 1, wherein a value of each m-th compensating element in an m-th compensating matrix is equal to an m-th actual grayscale value of a corresponding pixel in the electronic paper display minus an m-th-level grayscale value, a position of the corresponding pixel in the electronic paper display is the same as the m-th compensating element in the m-th compensating matrix, m is an positive integer, and $1 \leq m \leq N$.

3. The method as claimed in claim 1, further comprising:

generating a compensated image matrix of the input image; and making the electronic paper display display the output image according to the compensated image matrix, wherein compensated image elements in the compensated image matrix are arranged corresponding to the pixel array, and a value of each compensated image element in the compensated image matrix is equal to a grayscale value of a corresponding pixel in the input image minus a value of a corresponding compensating element in a compensating matrix corresponding to the grayscale value, and positions of the corresponding pixel in the input image and the corresponding compensating element in the compensating matrix corresponding to the grayscale value are the same as the compensated image element in the compensated image matrix.

4. A method for generating a compensating matrix set, applied to an electronic paper display displaying N-level grayscale images, wherein pixels of the electronic paper display are arranged as a pixel array, and the N-level grayscale comprises grayscale values from a first-level grayscale value to an N-th-level grayscale value, the method comprising:

providing a first standard image where each pixel has the first-level grayscale value;

displaying a first image by the electronic paper display corresponding to the first standard image;

using a microscope to capture a plurality of partial images of the electronic paper display when the electronic paper display displays the first image;

dividing the plurality of partial images into a plurality of pixel images;

determining a first luminance value of each pixel of the electronic paper display when the electronic paper display displays the first image according to the plurality of pixel images;

normalizing the first luminance value of each pixel;

determining the first actual grayscale value of each pixel according to the normalized first luminance value;

obtaining a first actual grayscale value of each pixel of the electronic paper display when the electronic paper display displays the first image;

comparing the first-level grayscale value with the first actual grayscale value of each pixel to generate a first compensating matrix, wherein compensating elements in the first compensating matrix are arranged corresponding to the pixel array;

providing standard images from a second standard image to an N-th standard image which respectively correspond to grayscale values from a second-level grayscale value to the N-th-level grayscale value, and repeating the steps above to respectively generate compensating matrices from a second compensating matrix to an N-th compensating matrix; and generating the compensating matrix set, wherein the compensating matrix set comprises compensating matrices from the first compensating matrix to the N-th compensating matrix, and N is a positive integer.

5. An electronic paper display, comprising:

a processor, receiving an input image;

a storage module, storing a built-in compensating matrix set generated by the method for generating the compensating matrix set as claimed in claim 4, a compensating module, coupled between the processor and the storage module, using the compensating matrix set to compensate the input image to generate a compensated image matrix and transmitting the compensated image matrix to the processor, and a display, coupled to the processor, receiving the compensated image matrix processed by the processor and displaying an output image according to the processed compensated image matrix.

6. The electronic paper display as claimed in claim 5, wherein a size of the compensated image matrix generated by the compensating module is the same as the pixel array of the display, and a value of each compensated image element in the compensated image matrix is equal to a grayscale value of a corresponding pixel in the input image minus a value of a corresponding compensating element in a compensating matrix corresponding to the grayscale value, and positions of the corresponding pixel in the input image and the corresponding compensating element in the compensating matrix corresponding to the grayscale value are the same as the compensated image element in the compensated image matrix.

* * * * *